US005837917A

United States Patent [19]

Macnab et al.

[11] Patent Number: 5,837,917

[45] Date of Patent: Nov. 17, 1998

[54] COOLING APPARATUS FOR A MISSILE LAUNCHER SYSTEM

[75] Inventors: Donald A. Macnab, San Jose; James P. Wei, Fremont, both of Calif.

[73] Assignee: Northrop Grumman Corporation, Los Angeles, Calif.

[21] Appl. No.: 881,641

[22] Filed: Jun. 24, 1997

[51] Int. Cl.[6] ..... F41F 3/04

[52] U.S. Cl. ..... 89/1.8; 89/1.816; 89/1.809

[58] Field of Search ..... 89/1.817, 1.8, 89/1.809, 1.81, 1.816, 1.819; 14/238

[56] References Cited

U.S. PATENT DOCUMENTS

| | | | |
|---|---|---|---|
| 3,182,554 | 5/1965 | Barakauskas | 89/1.81 |
| 3,499,364 | 3/1970 | D'Ooge | 89/1.817 |
| 3,516,380 | 6/1970 | Johnston | 114/238 |
| 4,373,420 | 2/1983 | Piesik | 89/1.817 |
| 4,436,016 | 3/1984 | Olmsted et al. | 89/1.809 |
| 4,686,884 | 8/1987 | Piesik | 89/1.816 |
| 5,162,605 | 11/1992 | Piesik | 89/1.817 |
| 5,191,162 | 3/1993 | Czimmek | 89/1.802 |
| 5,375,502 | 12/1994 | Bitsakis | 89/1.81 |

*Primary Examiner*—Charles Jordan
*Assistant Examiner*—Theresa M. Wesson
*Attorney, Agent, or Firm*—Walter G. Sutcliff

[57] ABSTRACT

A cooling system for a missile launcher having a plurality of missile-containing cells connected to a common plenum. Disposed in the plenum beneath each missile is an impingement plate in the path of hot exhaust gas from the missile. A cooling water injection nozzle is arranged below each impingement plate and is supplied with cooling water during a hot missile launch to cool the hot exhaust gas and the plenum.

14 Claims, 10 Drawing Sheets

FIG.9
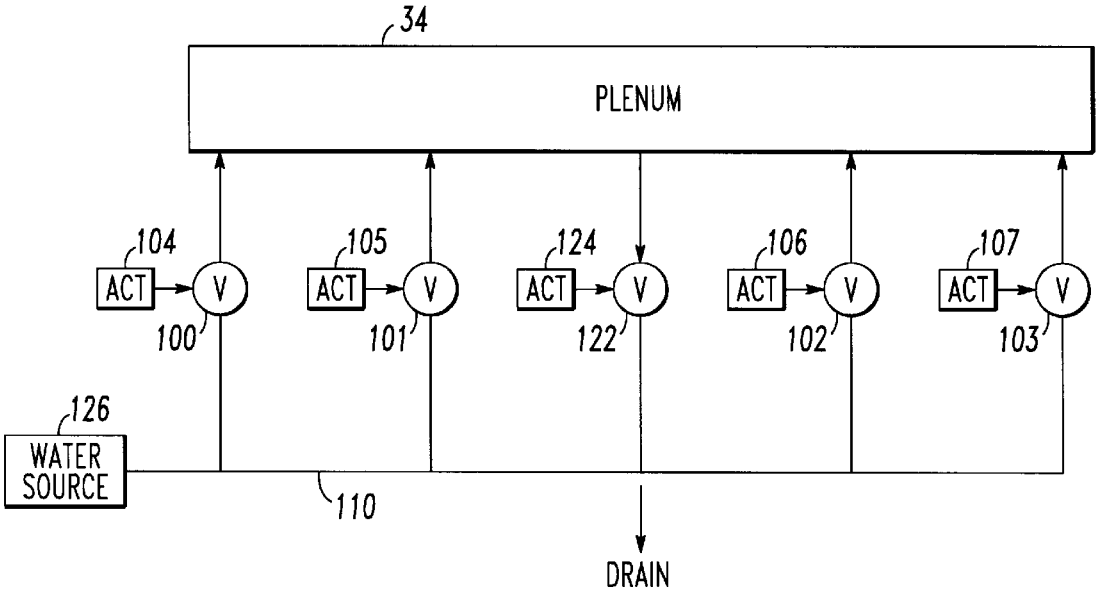
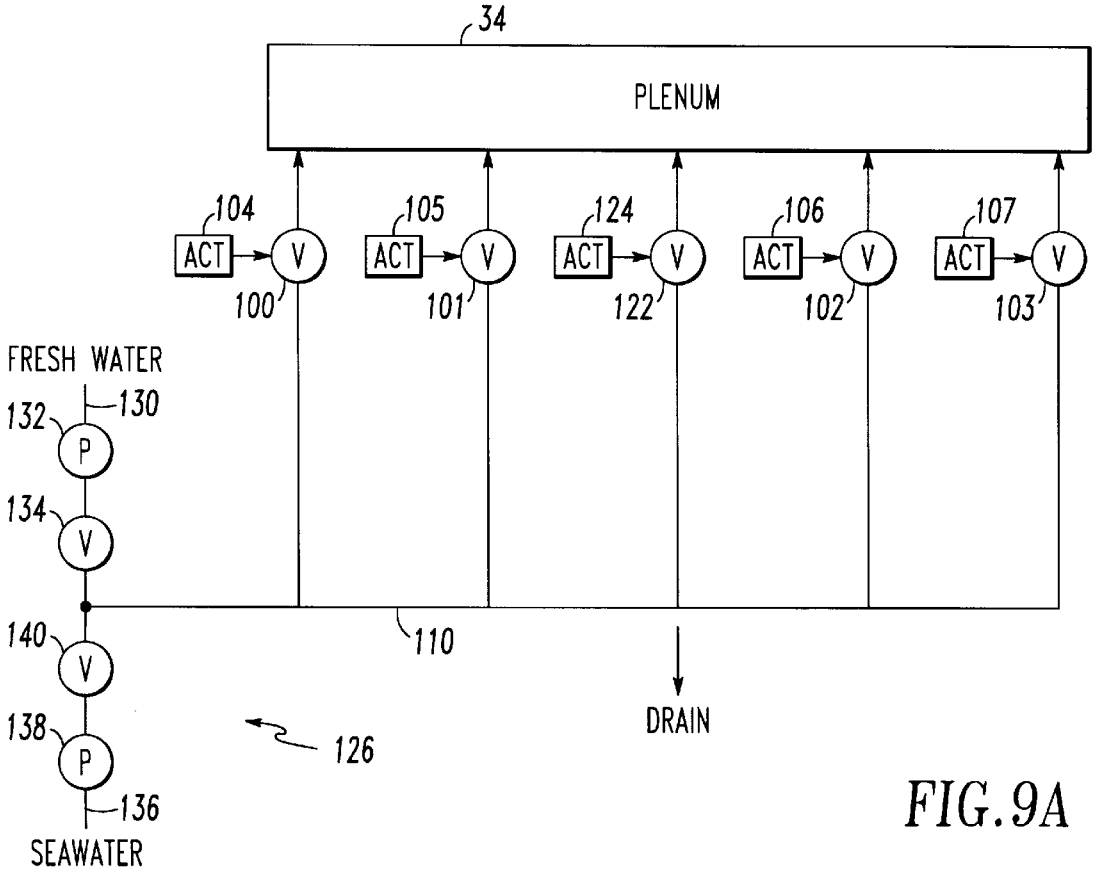
FIG.9A

FIG.9B
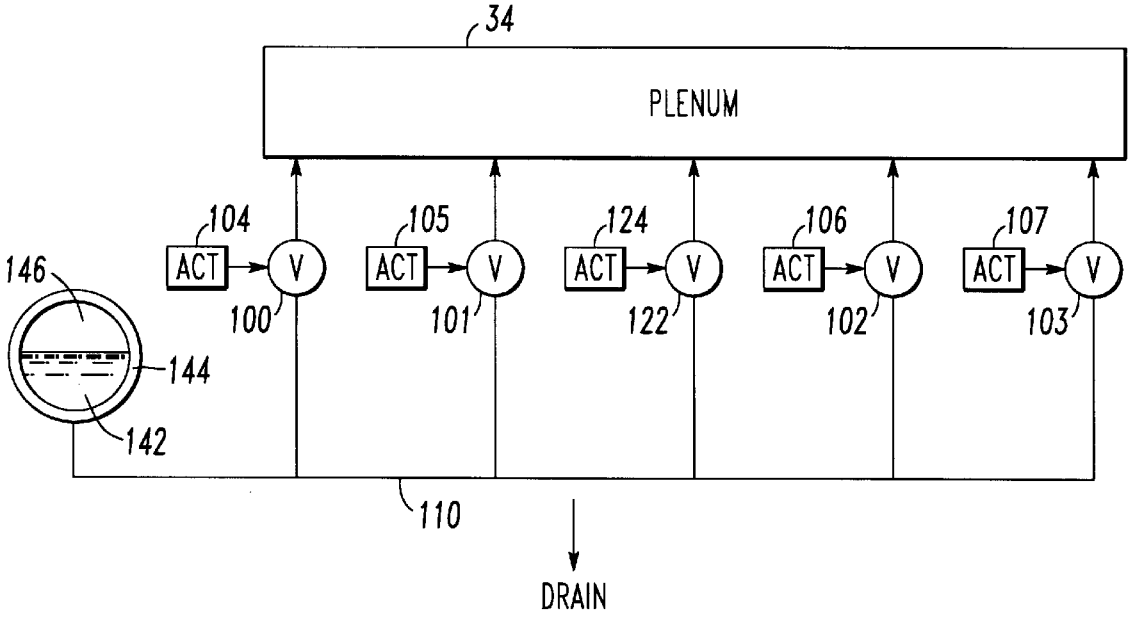
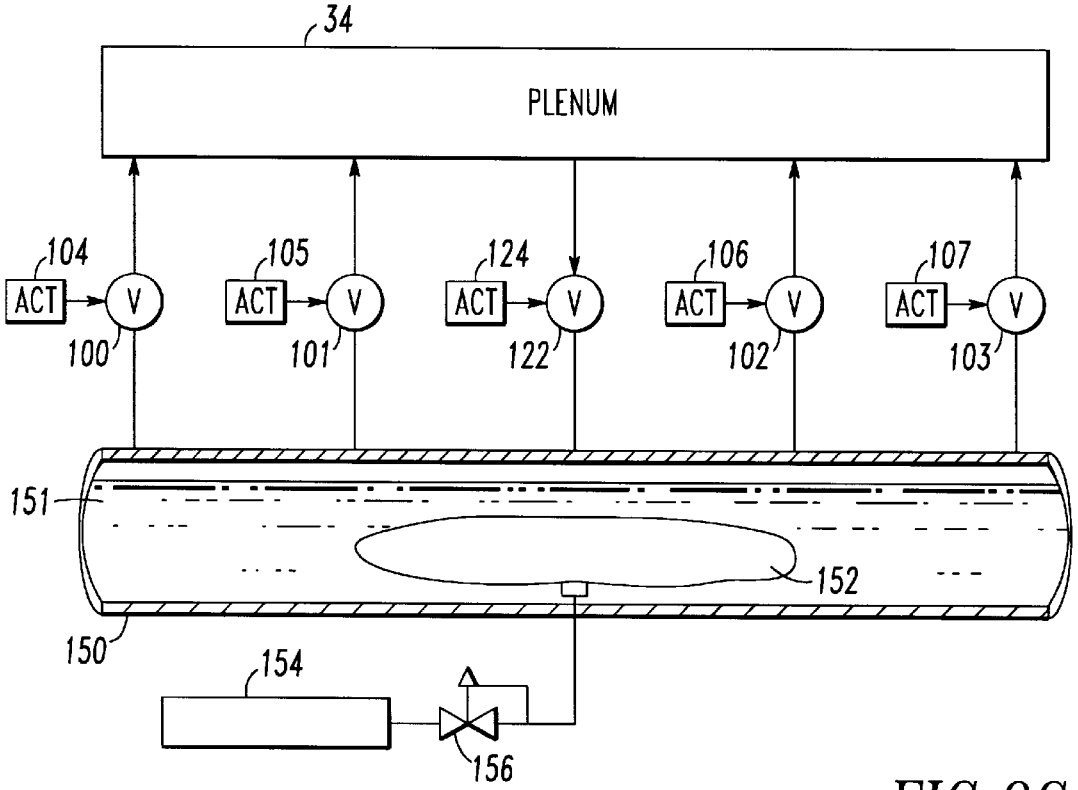
FIG.9C

FIG. 10
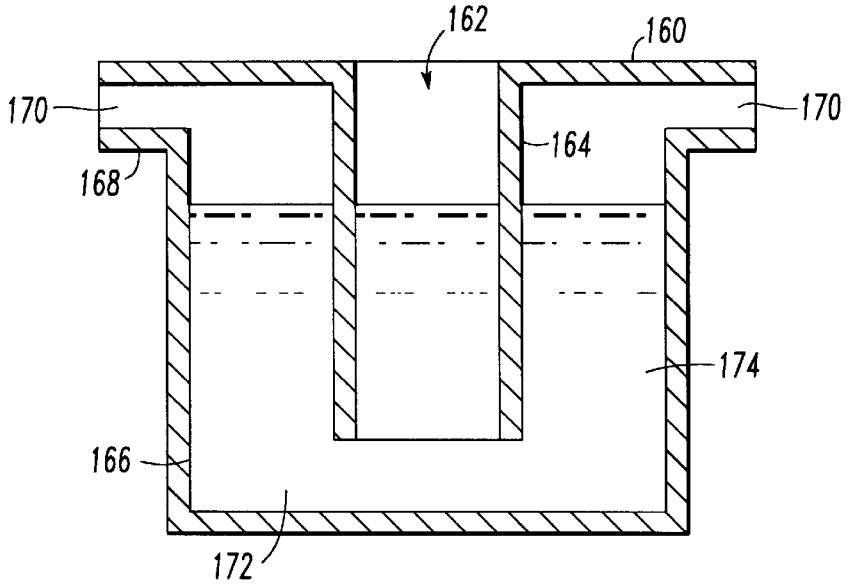
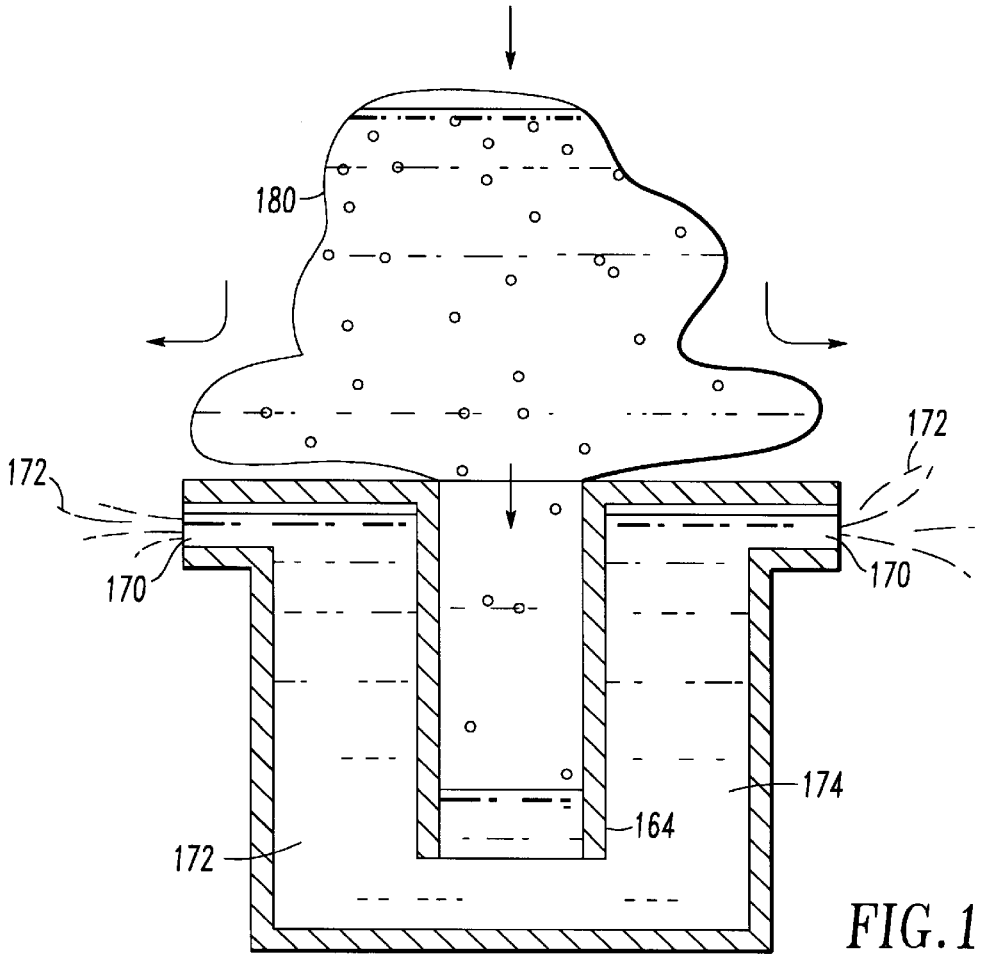
FIG. 10A

COOLING APPARATUS FOR A MISSILE LAUNCHER SYSTEM

CROSS REFERENCE TO RELATED APPLICATION

The present application is related in subject matter to Ser. No. 08/881,642, filed concurrently herewith, entitled "Missile Launching Apparatus", and assigned to the same assignee as the present invention.

BACKGROUND OF THE INVENTION

1. Field of the Invention

The invention in general relates to missile launchers and more particularly to an arrangement for cooling a plenum section of the missile launcher upon a hot launch of a missile.

2. Description of Related Art

One typical missile launch system for a surface vessel is comprised of a module of eight cells arranged in two rows of four cells each, with a relatively narrow channel, or passageway, between the two rows. Each cell is adapted to receive a missile containing canister having a ready to fire missile inside.

The cells are collectively coupled to a plenum at their lower ends and when any missile of the module is hot launched, the hot exhaust gases are directed into the plenum and out through the narrow passageway between the rows of cells.

Although the apparatus of existing systems ensures that hot exhaust gases are directed away from the vessel when a missile is launched, the plenum must be lined with a relatively thick coating of ablative material to withstand the launch temperatures. This coating periodically must be replaced or changed for different types of missiles and therefore the equipment requires a great deal of maintenance.

Further, it would be desirable to reduce the relatively high infrared (IR) signature associated with the launch event.

The aforementioned application describes an arrangement which obviates the disadvantages of prior art systems by providing a cooling system for the launcher.

The present invention provides for specific cooling arrangements which result in an improved launcher with low IR signature and low maintenance.

SUMMARY OF THE INVENTION

Cooling apparatus is provided for a missile launcher system which has a plurality of cells, some or all of which have a respective missile to be launched, with the cells being connected to a common plenum at their lower ends.

Within the plenum is a plurality of impingement plates, each respectively located in the path of exhaust gas of a missile to be launched.

A water injection nozzle is disposed beneath each impingement plate with each nozzle being operable to spray water, supplied by a water supply means, into the plenum during a hot launch of a missile to cool the exhaust gases thereof.

BRIEF DESCRIPTION OF THE DRAWINGS

FIG. 9 is a block diagram of a water injection system.

FIGS. 9A to 9C are block diagrams of various water supply systems which may be utilized herein.

FIG. 10 illustrates an alternative water supply arrangement and FIG. 10A illustrates this alternate water supply during a hot launch.

DESCRIPTION OF THE PREFERRED EMBODIMENT

Figure 1:
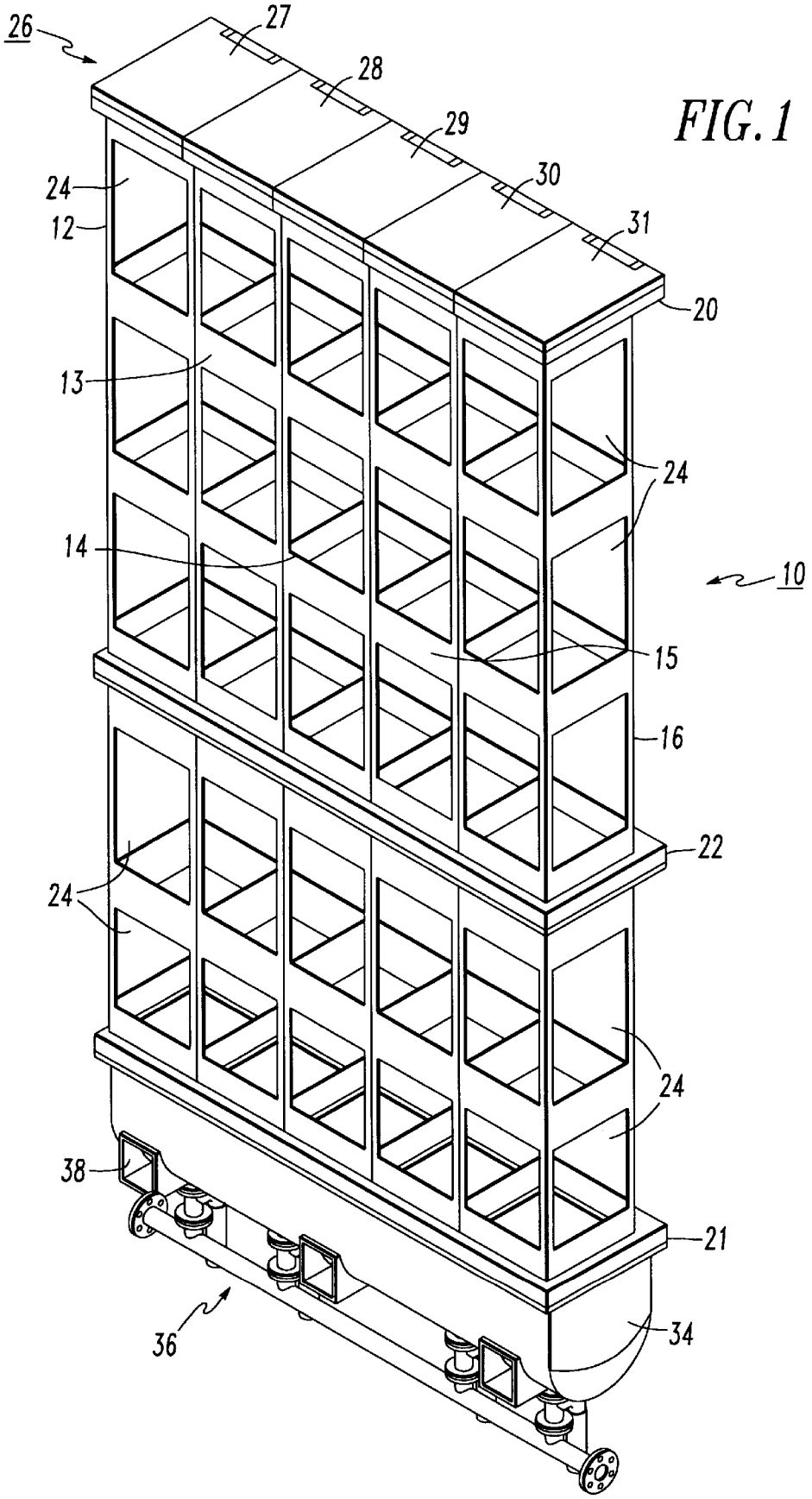
FIG. 1 is an isometric view of one type of launcher system in which the present invention may be utilized.

In the drawings, which are not necessarily to scale, like or corresponding parts are denoted by like or corresponding reference numerals.

The apparatus of FIG. 1 includes an array 10 of individual sleeves, five of which, 12 to 16, are illustrated by way of example. The upper end of each sleeve is defined as the muzzle end and the lower end is defined as the breech end. The sleeves 12 to 16 are maintained in a linear array by means of a muzzle frame 20, a breech frame 21, and an intermediate frame 22.

The overall weight of the apparatus may be reduced and access to the interior of the sleeves 12 to 16 may be obtained by providing the side walls of the sleeves with a plurality of cutouts 24.

In order to provide ballistic and environmental protection for the muzzle ends of the sleeves 12 to 16, there is provided a hard hatch assembly 26 which includes a plurality of individually operable hatch doors 27 to 31 respectively covering the muzzle ends of sleeves 12 to 16. The opposite, or breech ends of the sleeves 12 to 16 are collectively connected to a common plenum 34 having a water supply system 36, to be subsequently described. The outside of the plenum 34 includes a series of cleats 38 for fastening the structure to a foundation.

Figure 2:
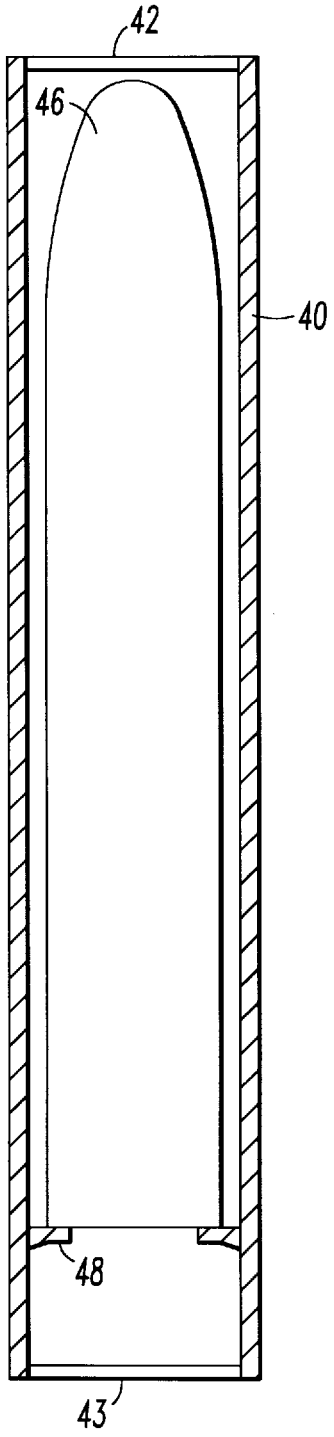
FIG. 2 is a cross sectional rudimentary view of a missile within a carrying container.

The sleeves 12 to 16 are of a particular size to accommodate a missile carrying canister such as illustrated in FIG. 2. The canister 40, which may be of corrugated construction, includes, at the upper end thereof, a frangible muzzle seal 42, and at the lower end thereof, a frangible breech seal 43. The interior of the canister 40 contains a missile 46 positioned on support 48 and in condition to be launched. Such structure is commonly known as an all up round (AUR).

Figure 3:
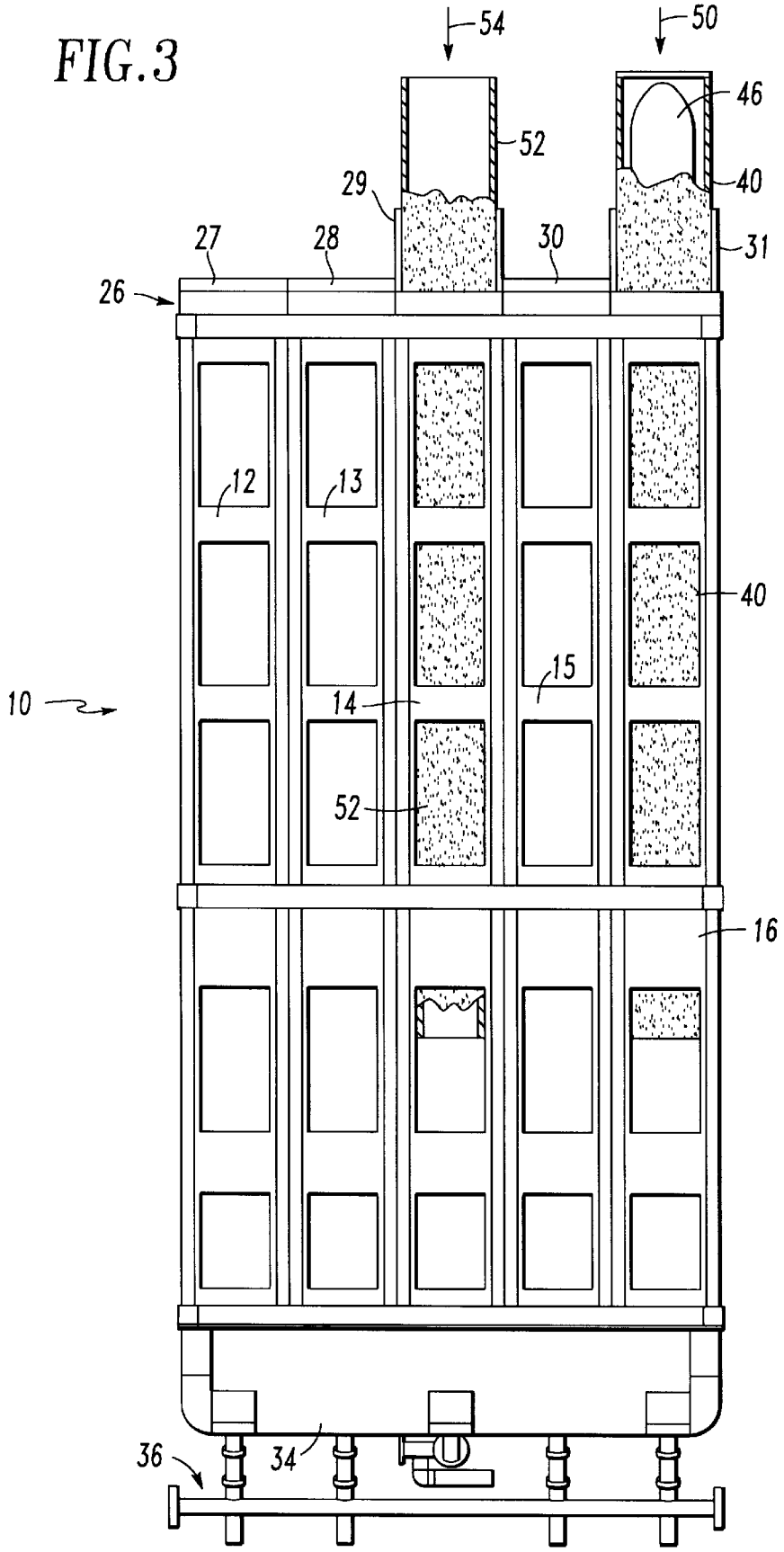
FIG. 3 is a view of the array of FIG. 1 illustrating the insertion of a missile carrying container and a gas uptake liner.

As illustrated in FIG. 3, the missile containing canister 40 is being lowered into one of the sleeves, sleeve 16, through open hatch door 31, as indicated by the arrow 50. For ease of viewing, the surface of the canister 40 has been stippled. Missile 46 is of the type that is hot launched and which produces hot exhaust gases directed into the adjacent plenum 34 during the launch.

In order to remove the hot detrimental exhaust gases from the apparatus, one of the sleeves is utilized to provide an exhaust path to the atmosphere. In FIG. 3, sleeve 14 is selected as the exhaust sleeve. If the sleeve walls have cutouts, as illustrated, sleeve 14 is provided with a removable liner or insert 52, open at both ends and shown as being inserted through hatch door 29 into sleeve 14, as indicated by arrow 54.

Figure 4:
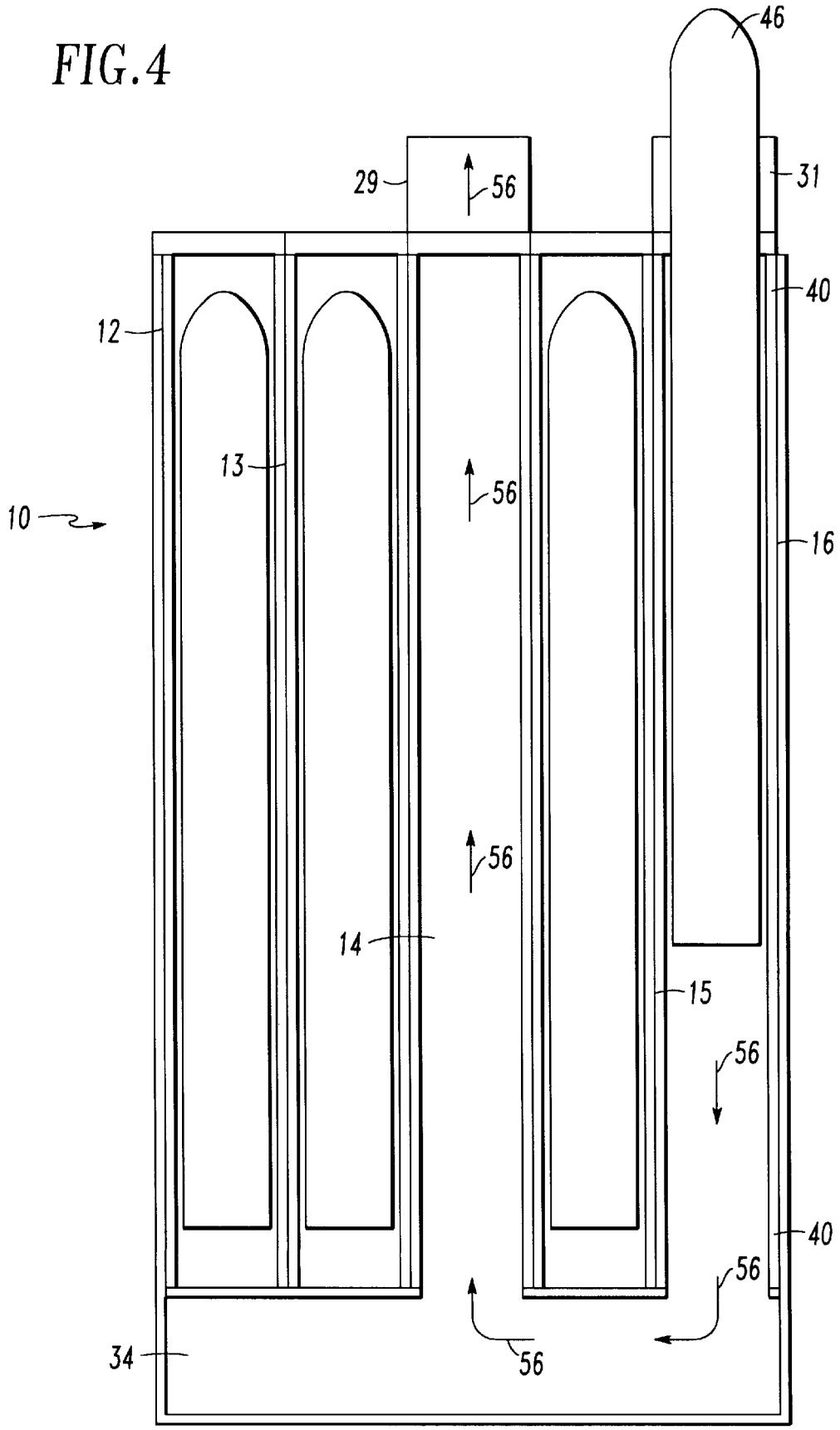
FIG. 4 illustrates gas flow during a hot launch of a missile.

FIG. 4 illustrates the array 10 wherein the sleeves 12, 13, 15 and 16 contain missiles and sleeve 14 is used as the gas uptake. A hot flyout launch by missile 46 from sleeve 16 produces hot exhaust gases which, as indicated by arrows 56, are directed into plenum 34 and up and out the middle sleeve 14. The hot launch of the other missiles will likewise produce exhaust gases which are directed out of the sleeve assembly and away from the vessel carrying the launch apparatus.

Figure 5:
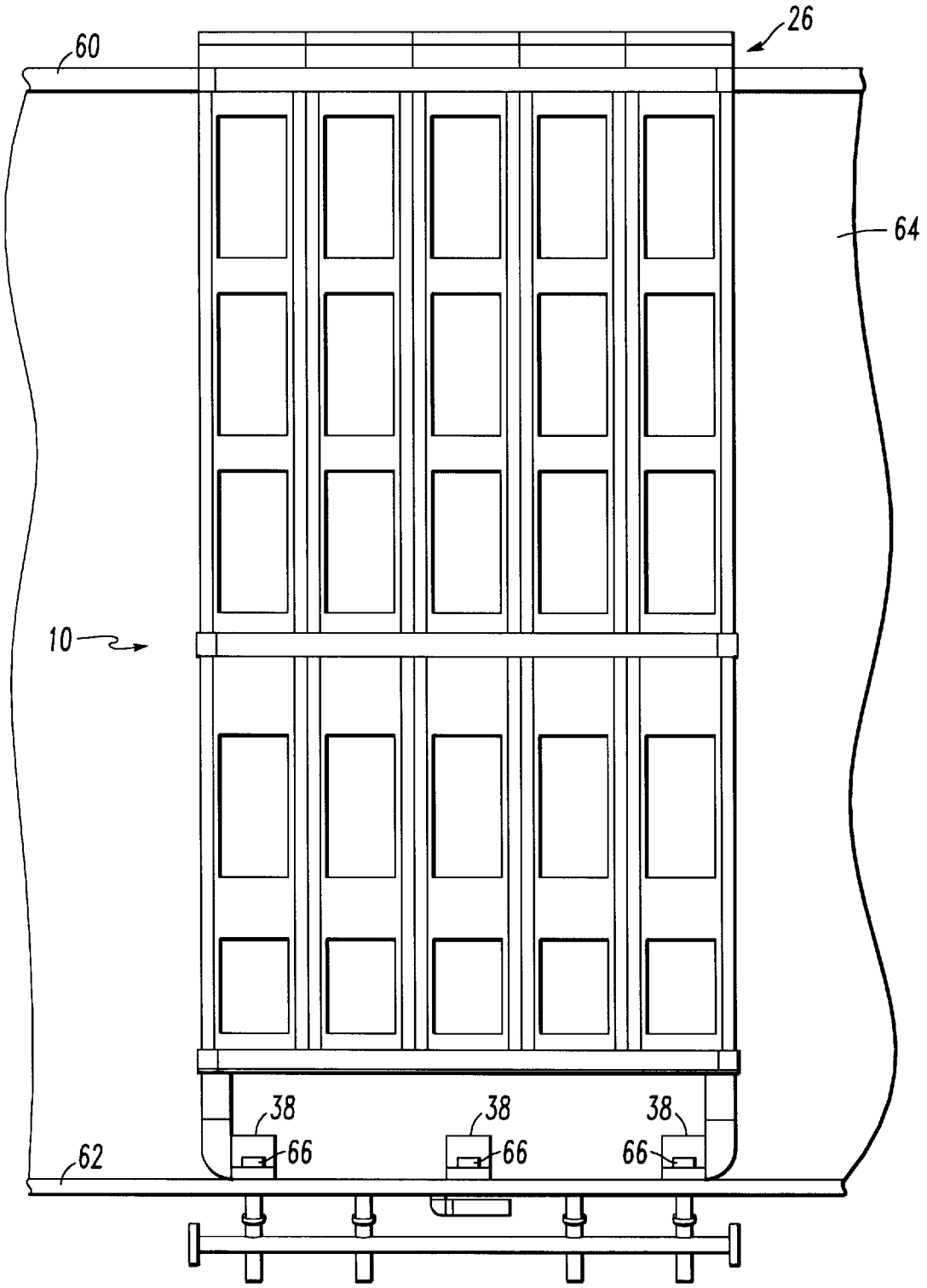
FIG. 5 illustrates the system of FIG. 1 as it may be installed on a surface vessel.

FIG. 5 illustrates one type of mounting arrangement which may be utilized. The array of sleeves 10 is situated below the deck 60 of a surface vessel such that the hard hatch assembly 26 is at deck level. The plenum 34 is secured to an interior foundation 62, located in the interior 64 of the vessel, by means of cleats 38 and fasteners such as bolts 66. With this arrangement exhaust gases do not enter interior 64, but rather are directed up and away from deck 60 to the surrounding atmosphere.

The apparatus, in addition to accommodating missiles of the hot launch variety, can also accommodate submarine launch tactical missiles of the cold launch type which pop up and are ignited after ejection and when in the air. For these latter type missiles, the exhaust sleeve is not utilized and if a particular scenario just uses missiles of the cold launch variety, then all of the sleeves, may be used to accommodate AURs.

If a hot launch is to be conducted however, then the exhaust sleeve is utilized and in addition, means must be provided to cool the plenum 34 by water injection into the exhaust plume. This water injection not only preserves the structural integrity of the plenum 34 and eliminates the need for ablative materials, but also prevents secondary combustion at the uptake exit and reduces the IR signature at the launcher apparatus.

Figure 6:
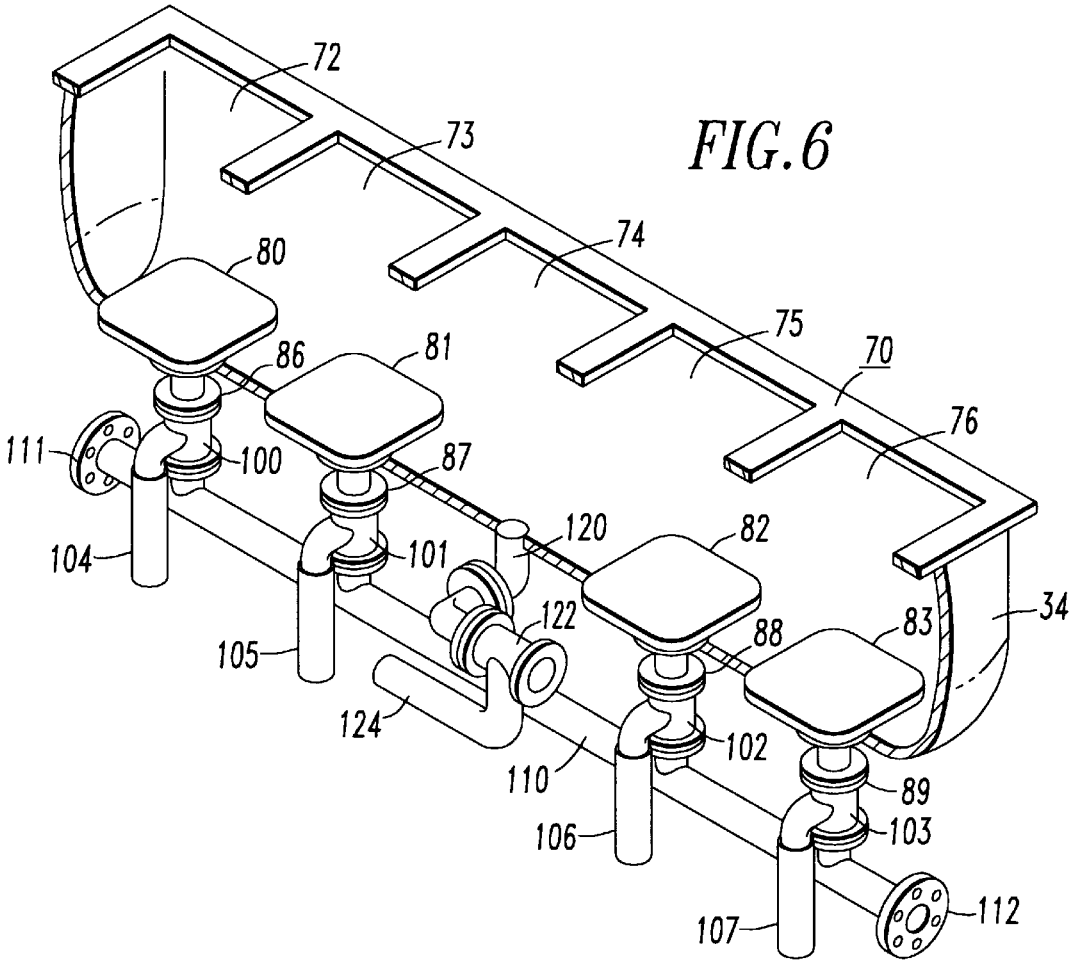
FIG. 6 is a cut away view of the plenum illustrated in FIG. 1.
Figure 7:
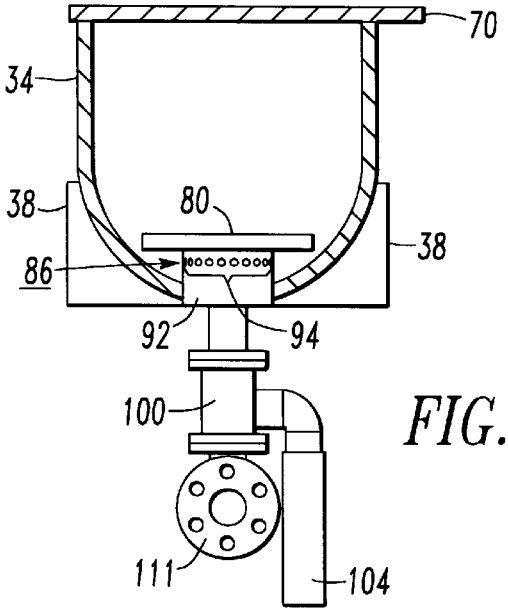
FIG. 7 is an end view of the plenum.

One type of water injection system is illustrated in FIGS. 6 and 7. In the cut away view of FIG. 6 the plenum is seen to include a top flange 70 having openings 72 to 76 adjacent to the breech ends of respective sleeves 12 to 16 (FIG. 1). Disposed within the plenum 34 is a series of impingement plates 80 to 83 each having a flat upper surface against which an exhaust plume impinges from missiles in respective sleeves 12, 13, 15 and 16. No impingement plate is required for sleeve 14 which functions as the exhaust sleeve.

Figure 8:
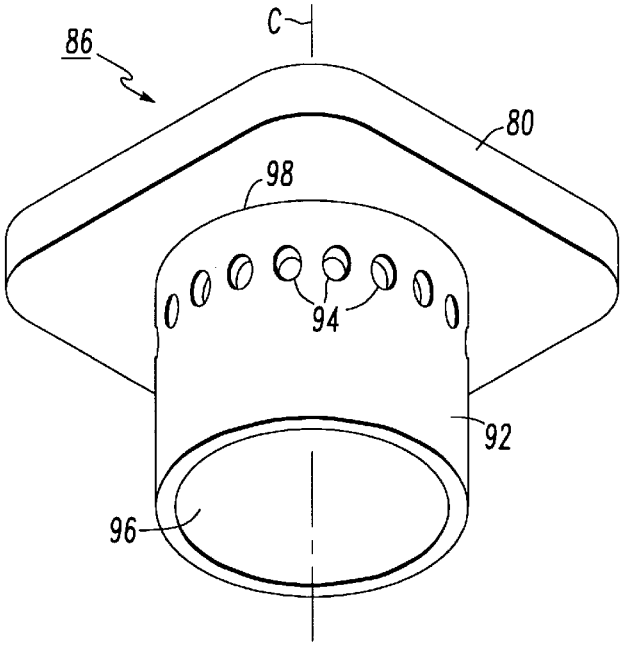
FIG. 8 is view of a water injection nozzle illustrated in FIG. 7, and FIGS. 8A and 8B are views of alternative nozzle embodiments which may be utilized.

Connected to the underside of each of the impingement plates 80 to 83 is a respective water injection nozzle 86 to 89. A typical water injection nozzle 86 may be seen in the end view of FIG. 7 which shows the arrangement under first sleeve 12. As seen in the enlarged view in FIG. 8, the water injection nozzle 86, which is typical of the other water injection nozzles, includes a metal hollow cylinder 92 surrounding a central longitudinal axis C. Around the upper periphery thereof is a series of apertures 94 through which water under pressure, delivered to the interior 96 of hollow cylinder 92 via valve 100, is injected radially into the plenum 34. The water injection nozzle 86, and more particularly, metal cylinder 92, is positioned beneath the impingement plate 80 and is affixed thereto at its upper end 98.

Figure 8A:
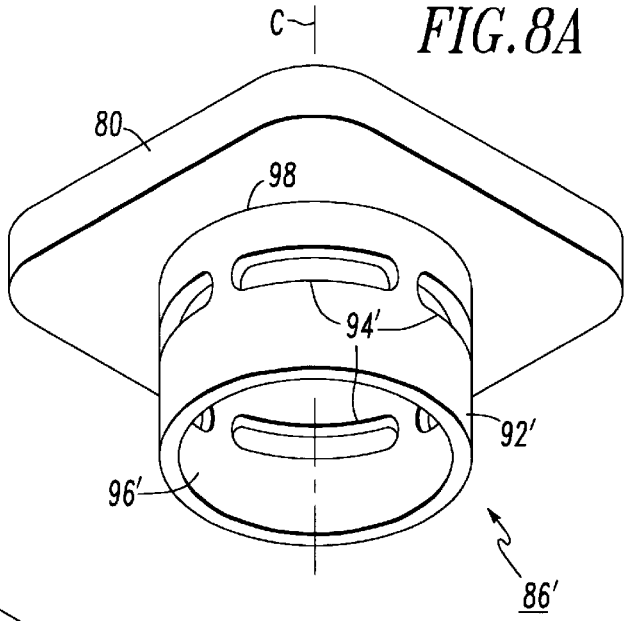
Figure 8B:
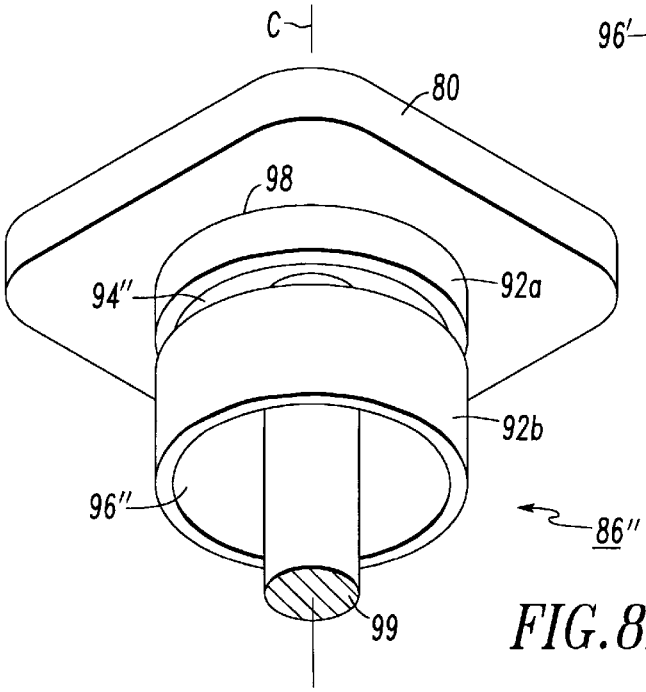

FIG. 8A illustrates an alternate water injection nozzle 86' wherein the apertures for injecting water are in the form of slits 94', and FIG. 8B illustrates an embodiment of a water injection nozzle 86" wherein water is injected through a continuous 360° slit 94". For this latter arrangement, the metal cylinder is in two pieces, 92*a* and 92*b*, and the impingement plate is supported against exhaust gas loads by means of a central longitudinal support member 99.

Referring once again to FIG. 6, water may be selectively supplied to the water injection nozzles 86 to 89 by means of respective valves 100 to 103, the opening and closing of which is controlled by respective valve actuators 104 to 107. The water is supplied from a source into a manifold pipe 110 having end flanges 111 and 112. One of these flanges 111 or 112 may be connected to an input water source while the other may be capped off or connected to a subsequent missile launcher array.

Injected water accumulated in the plenum may be removed through a drain 120 in fluid communication with a drain valve 122, the opening and closing of which is governed by valve actuator 124. A block diagram of the water supply and drainage arrangement is illustrated in FIG. 9.

A source of water 126 is connected to the manifold pipe 110 and is supplied under pressure just prior to a hot launch. Upon opening of the appropriate valve, water is sprayed into the plenum 34 at a predetermined rate for a period of time determined by a missile away signal. At some time during or after the launch, the drain valve 122 may be opened to remove any accumulated water in the plenum 34.

FIG. 9A is similar to FIG. 9 and shows a water source 126 for use on a ship and which provides the option of selecting either fresh water or seawater. More particularly, water source 126 includes fluid conduit 130 which is connected to an onboard fresh water supply (not shown) from which fresh water may be delivered to manifold pipe 110 by means of pump 132 and controlled valve 134. For seawater cooling, fluid conduit 136, connected to the seawater environment, will deliver seawater to manifold pipe 110 via pump 138 when controlled valve 140 is activated.

FIGS. 9B and 9C illustrate self contained water sources which do not rely on the ship's supply. In FIG. 9B, sufficient water 142 for launch of four missiles (in the example being illustrated) is contained within a pressurized accumulator 144. As each missile is launched, the pressure within the accumulator 144 decreases correspondingly, however gas within pressurized volume 146 is initially supplied at a predetermined pressure to allow for the firing of the four missiles.

FIG. 9C illustrates a pressurized self contained water source arrangement wherein the pressure for injecting the cooling water is maintained constant even after each firing of a missile. The arrangement of FIG. 9C includes a container 150 for cooling water 151, with the interior of the container 150 having an inflatable gas impervious bladder 152. The inflatable bladder 152 is supplied with gas from a high pressure gas source 154, the output pressure of which is reduced to a desired pressure by pressure reducer 156. Pressure reducer 156 also functions to maintain the gas pressure within the inflatable bladder 152 at a constant value such that as the water 151 is used up for missile launches, the inflatable bladder 152 will expand and the pressure of the water supplied to the array of valves 100 to 103 will not diminish.

The container 150 may actually be a large closed ended pipe which fits directly beneath the valving array under the plenum 34. With this arrangement the container 150 is closely coupled to the valves 100 to 103 for quick response to valve opening signals.

FIG. 10 illustrates an embodiment of the invention which includes an impingement plate 160 having a central aperture 162. A hollow cylinder 164 extends from the central aperture 162 down into a case 166 having an upper peripheral lip 168 defining, with impingement plate 160, one or more apertures 170. The case 166, which is closed at its lower end, is filled with a sufficient amount of water 172 to accommodate a missile launch and which fills the hollow cylinder 164 as well as the annular chamber 174 around cylinder 164. Although not illustrated, the apparatus would normally include burst seals for sealing the central aperture 162 and apertures 170.

During a launch, and as illustrated in FIG. 10A, missile exhaust gas 180 impacts the impingement plate 160, as indicated by the solid arrows. As a consequence, water 172 in cylinder 164 is forced downward thus, in turn, forcing the water 172 in annular chamber 174 up and out through apertures 170 to perform the cooling function.

Although the present invention has been described with a certain degree of particularity, it is to be understood that various substitutions and modifications may be made without departing from the spirit and scope of the invention as defined in the appended claims.

What is claimed is:

1. Cooling apparatus for a missile launcher system which has a plurality of cells, some or all of which have a respective missile to be launched, said cells having their lower ends connected to a plenum, comprising:

(A) a plurality of impingement plates each respectively located in the path of exhaust gas of a missile to be launched;

(B) a water injection nozzle disposed beneath each said impingement plate and operable to spray water into said plenum during a launch of said missile to cool said exhaust gas and said plenum; and (C) water supply means for supplying water to said water injection nozzles.

2. Apparatus according to claim 1 wherein said water injection nozzle includes:

(A) a hollow cylindrical body for receiving said cooling water and disposed about a central longitudinal axis; and (B) said cylindrical body including aperture means arranged to direct said cooling water generally radially into said plenum.

3. Apparatus according to claim 2 wherein:

(A) said aperture means is constituted by a series of holes in the upper portion of said cylindrical body.

4. Apparatus according to claim 2 wherein:

(A) said aperture means is constituted by a series of slits in the upper portion of said cylindrical body.

5. Apparatus according to claim 2 wherein:

(A) said aperture means is constituted by a single slit disposed 360 degrees around the upper portion of said cylindrical body.

6. Apparatus according to claim 2 wherein:

(A) said cylindrical body is affixed to the underside of said impingement plate.

7. Apparatus according to claim 2 wherein:

(A) said cylindrical body is closed at the lower end thereof;

(B) said impingement plate includes a central aperture and a hollow cylinder depending therefrom;

(C) said hollow cylinder being positioned within said cylindrical body forming an annular chamber around said hollow cylinder, defining aperture means below said impingement plate; and (D) whereby when said exhaust gas from said missile strikes said impingement plate, water in said cylindrical body is forced downward and forces water in said annular chamber out through said aperture means.

8. Apparatus according to claim 1 wherein:

(A) said impingement plate is flat.

9. Apparatus according to claim 1 wherein:

(A) said water injection nozzles are disposed in a common plenum.

10. Apparatus according to claim 1 wherein said water supply means includes:

(A) a plurality of valves each connected to a respective one of said water injection nozzles;

(B) a source of water; and (C) a manifold pipe connecting said source of water to said plurality of valves.

11. Apparatus according to claim 10 wherein:

(A) said source of water includes a first source and a second source; and which includes (B) means for selecting said first or said second source.

12. Apparatus according to claim 11 wherein:

(A) said apparatus is for use on a sea going vessel; and (B) said first source is fresh water and said second source is seawater.

13. Apparatus according to claim 10 wherein said water supply means includes:

(A) a closed pressure accumulator for containing said water; and (B) said accumulator having a pressurized gas therein of sufficient pressure to force said water into said injection nozzles.

14. Apparatus according to claim 1 wherein said water supply means includes:

(A) a plurality of valves each connected to a respective one of said water injection nozzles;

(B) a water container connected to said valves;

(C) a gas impervious inflatable bladder disposed within said water container; and (D) means for supplying the interior of said bladder with a gas of constant pressure.

* * * * *